United States Patent [19]

Christensen et al.

[11] Patent Number: 4,496,205

[45] **Date of Patent: * Jan. 29, 1985**

[54] LOW OR ZERO INSERTION FORCE CONNECTOR FOR MULTI-PIN ARRAYS

[75] Inventors: Gordon D. Christensen, San Jose; Charles J. Donaher, Los Altos Hills, both of Calif.

[73] Assignee: Thomas & Betts Corporation, Raritan, N.J.

[ * ] Notice: The portion of the term of this patent subsequent to Dec. 27, 2000 has been disclaimed.

[21] Appl. No.: 401,369

[22] Filed: Jul. 23, 1982

[51] Int. Cl.[3] ..... H01R 13/629

[52] U.S. Cl. ..... 339/74 R; 339/75 M

[58] Field of Search ..... 339/74 R, 75 M, 75 R

[56] References Cited

U.S. PATENT DOCUMENTS

| | | | |
|---|---|---|---|
| 2,126,674 | 8/1938 | Stout | 173/328 |
| 3,395,377 | 7/1968 | Straus | 339/17 |
| 3,426,313 | 2/1969 | Wycheck | 339/74 |
| 3,478,301 | 11/1969 | Conrad et al. | 339/75 |
| 3,489,986 | 1/1970 | Frederick | 339/75 M |
| 3,526,869 | 9/1970 | Conrad et al. | 339/75 |
| 3,553,630 | 1/1971 | Scheingold et al. | 339/74 |
| 3,555,488 | 1/1971 | McIver et al. | 339/75 |
| 3,763,459 | 10/1973 | Millis | 339/75 M |
| 3,869,185 | 3/1975 | Teagno | 339/75 M |
| 4,050,758 | 9/1977 | Curley | 339/74 |
| 4,080,032 | 3/1978 | Cherian et al. | 339/75 |
| 4,159,154 | 6/1979 | Arnold | 339/74 |
| 4,159,861 | 7/1979 | Anhalt | 339/75 |
| 4,179,177 | 12/1979 | Lapraik | 339/74 R |
| 4,196,955 | 4/1980 | Anhalt | 339/74 |
| 4,274,694 | 6/1981 | Leather | 339/74 R |
| 4,290,661 | 9/1981 | Burns | 339/75 M |
| 4,314,736 | 2/1982 | Demnianiuk | 339/74 |
| 4,405,191 | 9/1983 | Fettig | 339/75 M |
| 4,422,703 | 12/1983 | Christensen et al. | 339/17 CF |

FOREIGN PATENT DOCUMENTS 1118852 12/1961 Fed. Rep. of Germany .

OTHER PUBLICATIONS

Connectors and Interconnections Handbook–Gerald L. Ginsberg–Editor, vol. 2, 1979, pp. 4–17 to 4–19 and pp. 4–20 to 4–22.

*Primary Examiner*—John McQuade
*Assistant Examiner*—Thomas M. Kline
*Attorney, Agent, or Firm*—Robert M. Rodrick; Salvatore J. Abbruzzese

[57] ABSTRACT

A connector for low or zero insertion force receipt of multi-pin arrays, such as those in very large scale integration (VLSI) components, includes cooperating camming surfaces having inclined ramps and slots. Selective longitudinal movement of a cam actuator causes vertical movement of a cam plate whereby self-biasing of connector contacts is opposed for ready pin insertion. Engagement between the cam plate and contacts ceases upon reverse movement of the cam actuator to permit the contacts to effect tight engagement with the pins under the influence of their such self-biasing forces.

16 Claims, 12 Drawing Figures

LOW OR ZERO INSERTION FORCE CONNECTOR FOR MULTI-PIN ARRAYS

FIELD OF THE INVENTION

This invention relates generally to electrical connectors and pertains more particularly to connectors of so-called zero or low insertion force type for use with multi-pin arrays.

BACKGROUND OF THE INVENTION

The primary advantage in the use of zero insertion force connectors, namely, minimizing loading of interfitting contacts during connection, takes on particularly great significance as the number of contacts simultaneously made increases to levels today seen with circuit components produced by very large scale integration (VLSI) techniques. In this sector, a VLSI device may present a twenty-by-twenty pin array, i.e., a total of four hundred pins, for simultaneous individual mating with collectively supported sockets. The loading forces attending such connection are, of course, cumulative of the force per mating contact pair and can readily amount to a level which may be unattainable for an assembler or not sustainable by support housings of the respective pins and sockets.

A further problem presented to the connector designer by VLSI is that of readily facilitating connection and disconnection and while minimizing the space in which such insertion connection and disconnection are to be effected. Customary practices in the art in larger environs are not applicable. In the above example of VLSI connection, the twenty-by-twenty pin array may be necessary within a square of about two inches per side, i.e., about one-tenth inch pin spacings in both column and row directions. Further connections may envision forty-by-forty pin arrays or more.

There are generally two types of zero insertion force connectors, one in which the contacts are normally closed and the other in which the contacts are normally open. The present invention relates to a zero insertion force connector having normally closed contacts. There are a number of known zero insertion force connectors of the closed-contact type which are used to make connection to conductors on printed circuit boards as well as to the leads of electronic packages or components and which employ camming devices for opening such contacts. Such connectors for printed circuit board connections are shown, for example, in U.S. Pat. Nos. 4,196,955; 4,159,861; 4,159,154; 3,553,630; 3,426,313 and 3,395,377 and in German Pat. No. 1,118,852. References showing connections to a multi-pin device in a closed contact connector include U.S. Pat. Nos. 4,080,032 and 4,050,758, the latter reference also being useful in connections to printed circuit boards.

In commonly-assigned, U.S. Pat. No. 4,422,703, issued on Dec. 27, 1983 in the name of the same inventors as herein, there is disclosed an electrical connector of zero or low insertion force receipt of multi-pin arrays such as those in VLSI components. Cam surfaces are employed for selective movement to oppose self-biasing forces of the connector contacts for pin insertion and reverse movement to permit the contacts to tightly engage the pins under the influence of the contact self-bias. While the connector shown therein contains attractive features and represents an advance in the art, the particular structure disclosed results in a height profile greater than that desired, particularly where pin connections in array greater than twenty-by-twenty are contemplated.

SUMMARY OF THE INVENTION

The primary object of the present invention is an improved connector for the interconnection of multi-pin arrays to corresponding contacts.

A more particular object of the present invention is to provide such interconnection of the multi-pin/contact arrays with zero or low insertion force.

In accordance with the invention, an electrical connector has a plurality of contacts having socket terminals disposed in an array corresponding to the multi-pin array and opposite terminals for connection to companion apparatus. The socket terminals are each formed with facing elements thereof closingly biased toward one another to electrically engage a pin to be received therein. Each facing element is defined to provide a partial boundary surface for the pin upon receipt thereof. A cam is supported for movement in the connector, such cam being adapted for receiving the terminal pins therein, the cam defining a further partial boundary surface for each terminal pin upon receipt thereof. The cam is movable from one position opposing such closing bias of the contact elements and displacing same to facilitate low-insertion force entry of pins therein to a second position wherein the cam surfaces are inactive in such function and permit selfbiased tight engagement of the contact elements with the pins. A cam actuator is provided for moving the cam between its first and second positions, the cam actuator being movable in a direction transverse to the movement of the cam.

In a particular form of the invention, the cam defines a plurality of openings, one connector contact being situate therein, the openings adapted to receive the terminal pins therein. Each cam opening has a cam surface therein that is movable with the cam to engage the facing contact elements upon movement of the cam to the first position.

In its particularly preferred embodiment, the cam and cam actuator are plates, the cam plate being movable in an upward direction in response to lateral movement of the cam actuator plate. Both the cam and cam actuator plates comprise cooperating camming surfaces, each including a plurality of successively spaced, inclined cam ramps and slots for effecting movement of the cam between the first and second positions.

DESCRIPTION OF THE PREFERRED EMBODIMENT

Figure 1:
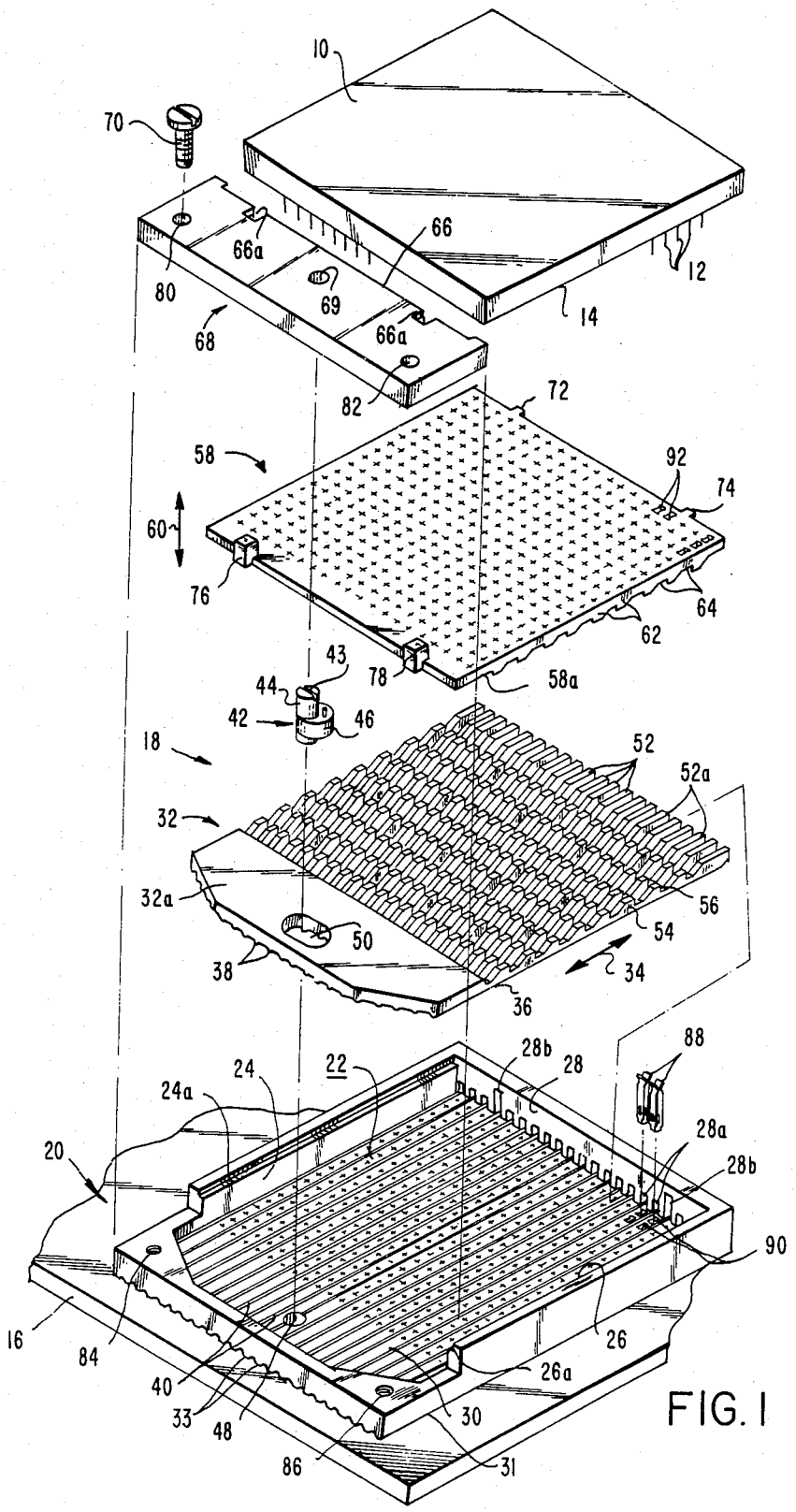
FIG. 1 is an exploded perspective view of a connector in accordance with the invention and showing both a VLSI device and a companion component to be connected thereby with the VLSI device.
Figure 5:
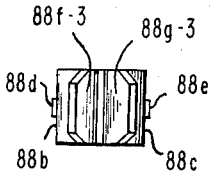
FIGS. 3–5 are respective front elevation, side elevation and top plan views of the contact of FIG. 2.
Figure 2:
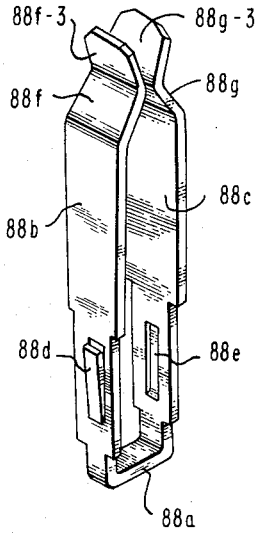
FIG. 2 is a perspective view of a contact for use in the connector of FIG. 1.

Referring to the drawing, FIG. 1 depicts an electronic component such as a VLSI device 10 having a plurality of terminal pins 12 projecting from the undersurface 14 of the device 10 and companion apparatus 16 for connection thereto, for example, a printed circuit board (PCB). A connector 18 for effecting such interconnection in accordance with the present invention comprises a housing including a base 20 having a compartment 22 defined by upstanding sidewalls 24 and 26, end wall 28 and floor 30. The undersurface 31 of the base 20 may include a plurality of longitudinally extending ribs 33 that provide stiffness to the base while permitting a minimal thickness.

A cam actuator 32 is configured in the form of an elongate plate within the base compartment 22 for sliding longitudinal movement relative thereto, as illustrated by the arrow 34. The undersurface 36 of the cam actuator 32 includes a plurality of longitudinally extending, laterally spaced teeth 38 that are adapted to slide within a like plurality of tracks 40 formed in the base floor 30. Movement of the cam actuator 32 is effected by an actuator pin 42 having a shaft 44 and an eccentric portion 46. The shaft 44 is adapted to be received in an aperture 48 in the base 20 and the eccentric portion 46 is captively retained in an elongate opening 50 provided through a solid portion 32*a* of the cam actuator 32. The opening 50 is formed to closely receive the eccentric portion 46 such that upon rotation of the pin 42, the eccentric portion 46 will engage the walls of the cam actuator adjacent the opening 50 and move the cam actuator plate longitudinally relative to the base 20. A slot 43 is provided in the upper surface of the pin shaft 44 to receive a screwdriver or like instrument for facilitating rotation of the pin 42.

The cam actuator 32, in its preferred form, includes a plurality of fingers 52 extending longitudinally from the cam actuator solid portion 32*a* and terminating in free ends 52*a*. Each of the fingers is laterally spaced by an opening (not shown). The upper surface of each finger 52 is a camming surface and includes thereon a plurality of inclined cam ramps 54 and slots 56, successively spaced in the longitudinal direction and described in more detail hereinbelow. The free ends 52*a* of the fingers 52 are adapted to be slidably received in corresponding openings 28*a* provided in the end wall 28 of the base 20 upon movement of the actuator 32.

A cam plate 58 overlies cam actuator 32, the cam plate 58 adapted to fit within the compartment 22 of base 20 and to move vertically relative thereto as shown by arrow 60. The bottom surface 58*a* of the cam plate 68 is a camming surface and comprises a plurality of laterally spaced, longitudinally extending rows of inclined cam ramps 62 and slots 64 that are adapted to cooperate with the cam ramps 54 and slots 56 on the cam actuator plate 32. Movement of the cam plate 58 is restricted to the vertical direction by the base end wall 28 and a front wall 66 of a cap 68 that is secured to the base 20 as by screws 70 (only one of which is shown). Tabs 72 and 74 project from the cam plate 58 and slide vertically within slots 28*b* in the end wall 28 while tabs 76 and 78 slide vertically within slots 66*a* in the front wall 66 in cap 68. The cap 68 further includes an aperture 69 for receiving the shaft 44 of the pin 42 for external access thereto. For assembly of the cap 68 to the base 20, the cap 68 has apertures 80 and 82 and base 20 has suitably threaded registering bores 84 and 86. In the preferred form, the base 20, cam actuator 32, cam plate 58 and the cap 68 are made of a suitably rigid plastic material.

As will be described in more detail hereinbelow, rotation of the pin 42 provides longitudinal movement of the cam actuator 32 which, in turn, with the cam ramps 62 of the cam plate riding on the cam ramps 54 of the cam actuator provides vertical upward or downward movement of the cam plate 58 within the connector 18.

VLSI device 10 has X-Y dimensions compatible with the base 20, base 20 having internal ledges as at 24*a* and 26*a* to support the VLSI device 10 in the connector 18. The pins 12 depend from the undersurface 14 of VLSI device 10 in an X-Y square array of rows and columns, for example, a twenty-pin by twenty-pin predetermined array having a total of four hundred pins. A like number of contacts 88 are supported in the base in a like array of apertures 90 provided in the base floor 30. As will be seen in detail in enlarged views of the drawing and as described hereinbelow, the cam plate 58 has apertures 92 extending therethrough and arranged in the same array as the contacts 88. The contacts 88 project upwardly from the base 20 through the lateral openings (not shown) between the fingers 52 and into the apertures 92 in the cam plate 58.

Figure 3:
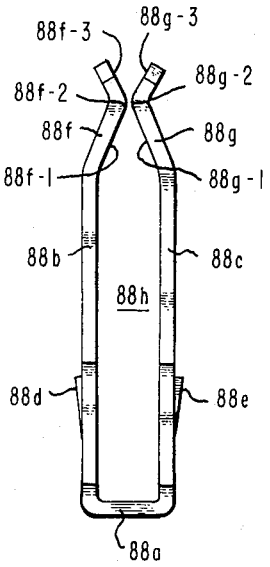
Figure 4:
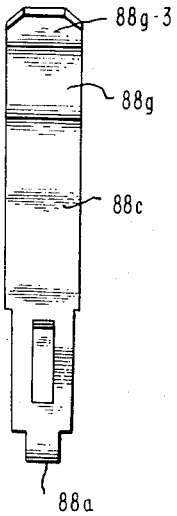

Turning now to FIGS. 2–5, contact 88 has a first terminal 88*a* which extends through the base apertures 90 to be accessible below the base 20 for engaging a terminal of companion apparatus, e.g., terminal 88*a* may be wave soldered to a conductive strip on PCB 16 (FIG. 1). Terminal 88*a* may also be formed in straight downward configuration for insertion into suitable metallized openings provided in PCB 16 and soldered therein by conventional wave-flow soldering techniques. A second terminal, serving as a pin-receiving socket element, is provided opposite the first terminal 88*a* and is defined by facing elements 88*b* and 88*c* which are formed in slef-biased preselected attitude to assume generally parallel stance (FIG. 3). Contact 88 is formed of beryllium copper, phosphorous bronze or like material having sufficient resilience to exhibit self-bias, whereby facing elements 88*b* and 88*c* will seek to return to such parallel relation, or other preselected self-biased attitude, after release from mutually applied outward forces thereon opposing such inward self-bias.

Figure 9:
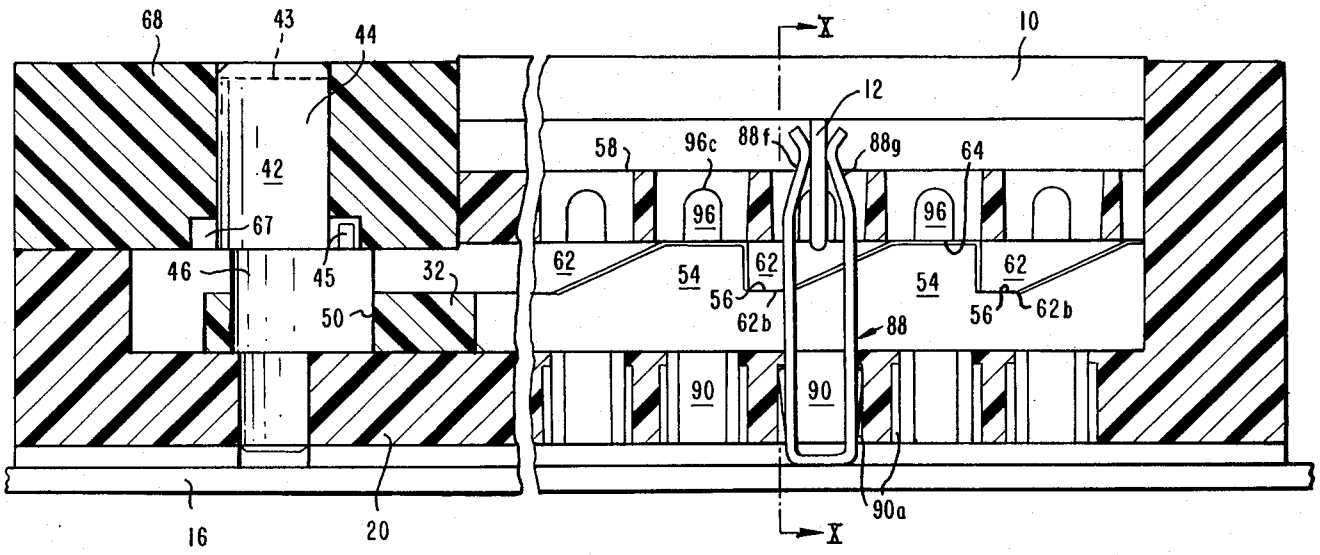
FIG. 9 is a fragmented view of the connector as would be seen along plane IX—IX of FIG. 6, with the contact, VLSI device and pin, and companion apparatus being shown without sectioning for convenience and simplification of discussion.

Lances 88*d* and 88*e* are struck from elements 88*b* and 88*c* to extend outwardly therefrom. Such lances 88*d* and 88*e* serve as resilient locking members for retaining the contacts 88 in the undercuts 90*a* formed in communication with the base apertures 90 (FIG. 9). These lances 88*d* and 88*e* also permit insertion of the contacts into the base 20 in a downward direction without requiring removal of the base 20 from the PCB 16. The contact 88 further includes inwardly directed portions 88*f* and 88*g* extending from elements 88*b* and 88*c* and that are inclined relative thereto. The undersurfaces 88*f*-1 and 88*g*-1 serve as camming portions for the cam plate 58 as will be described. The inclined portions terminate in pin engaging portions 88*f*-2 and 88*g*-2 that together define a throat or pin receiving opening. Outwardly flared upper pin entry sections 88*f*-3 and 88*g*-3 complete the contact.

One such contact 88 is shown in conjunction with cam plate 58 in FIG. 6, which is a view enlarged approximately ten times actual size for the two-inch square, twenty-by-twenty array as referred to hereinabove. A contact 88 would, of course, be resident in each of plate apertures 92, but such other contacts are omitted here for convenience and to simplify exposition. The segment of plate 32 shown in FIG. 6 includes apertures 92*a* through 92*l*, each of which has identical outline and cofiguration, as now discussed with reference to aperture 92*g*.

Figure 6:
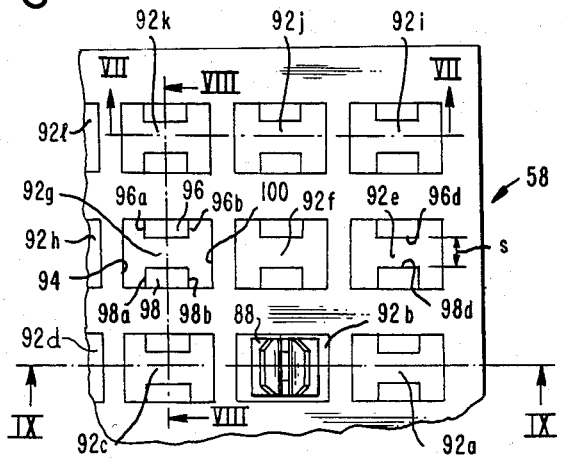
FIG. 6 is a plan view of a segment of the cam plate of the connector of FIG. 1 with one contact seated therein for purposes of explanation.
Figure 7:
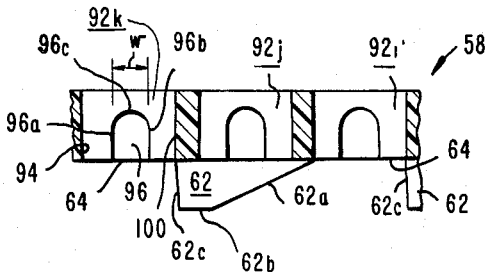
FIG. 7 is a partial sectional view of the cam plate of the connector of FIG. 1 as seen along plane VII—VII of FIG. 6.
Figure 8:
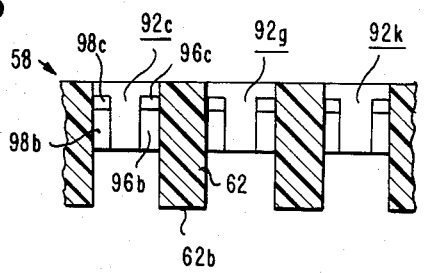
FIG. 8 is a partial sectional view of the cam plate of the connector of FIG. 1 as seen along plane VIII—VIII of FIG. 6.

Considering FIGS. 6–8 jointly with FIGS. 2–5, a wall 94 and the left side walls 96*a* and 98*a* of cam elements 96 and 98 provide a residence channel for contact facing element 88*b*. Similarly, a wall 100 and the right side walls 96*b* and 98*b* provide a residence channel for contact facing element 88*c*. The cam elements 96 and 98 extend into the space 88*h* defined by the facing elements 88*b* and 88*c*, the width, w, of each cam element 96 and 98 being less than the spacing between the parallel facing elements 88*b* and 88*c*. The spacing, s, between cam elements 96 and 98 (as illustrated with aperture 92*e*) is provided to be greater than the diameter of the VLSI terminal pin 12 such that opposing cam faces 96*d* and 98*d* provide partial boundaries for the pin 12 upon receipt therebetween. Each cam element 96 and 98 further includes a cam surface, as shown by a curved surface 98*c* in FIG. 7, arcuately joining the cam walls 96*a* and 96*b*. In such construction, each aperture 92 thereby includes a cam surface therewithin. Accordingly, if plate 58 were to be moved forwardly outwardly from the plane of FIG. 6, contact 88 remaining fixed as by the lances 88*d* and 88*e* in the base 20, cam surfaces 96*c* and 98*c* would engage contact camming portions 88*f*-1 and 88*g*-1 at the undersurfaces of the inclined contact portions and oppose the self-bias of facing elements 88*b* and 88*c* to displace the same outwardly of each other.

As further illustrated in FIGS. 7 and 8, the details of the lower camming surface of the cam plate 58 may be more fully understood. Each of the cam ramps 62 has an inclined surface 62*a* projecting downwardly from the lower surface of the cam plate terminating in a flat surface 62*b*. Depending from cam plate is surface 62*c* which preferably tapers outwardly from the flat surface 62*b* toward the root at the lower surface of the cam plate 58 so as to facilitate cooperative movement with like surfaces on the cam actuator 32. Slots 64 are provided alternately between each of the inclined cam ramps 62, such slots being substantially flush with the undersurface of the cam plate 58.

Figure 10:
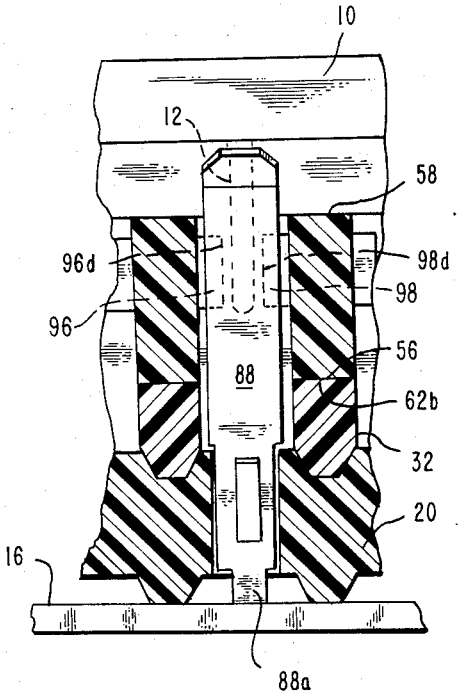
FIG. 10 is a partial sectional view as seen along plane X—X of FIG. 9, with the VLSI device and companion apparatus being shown without sectioning for like convenience and simplification of discussion.

Having described the details of the connector, its operation and function may now be more fully understood. As seen in FIGS. 9 and 10, the cam surfaces, i.e., cam elements 96 and 98, (cam element 98 not being shown in FIG. 9) are inactive in that they are remote from the inclined contact camming portions 88*f* and 88*g* and thus in nonengaging relation therewith. Cam plate 58 is in its lowermost position, the cam ramps 62 being disposed on the cam actuator 32 such that the flat surfaces 62*b* of the ramps 62 are situated in the slots 56 of the cam actuator 32. In such cam element inoperative position, the contact facing elements exert the full force of the contact self-bias upon the pin 12 therebetween.

Figure 11:
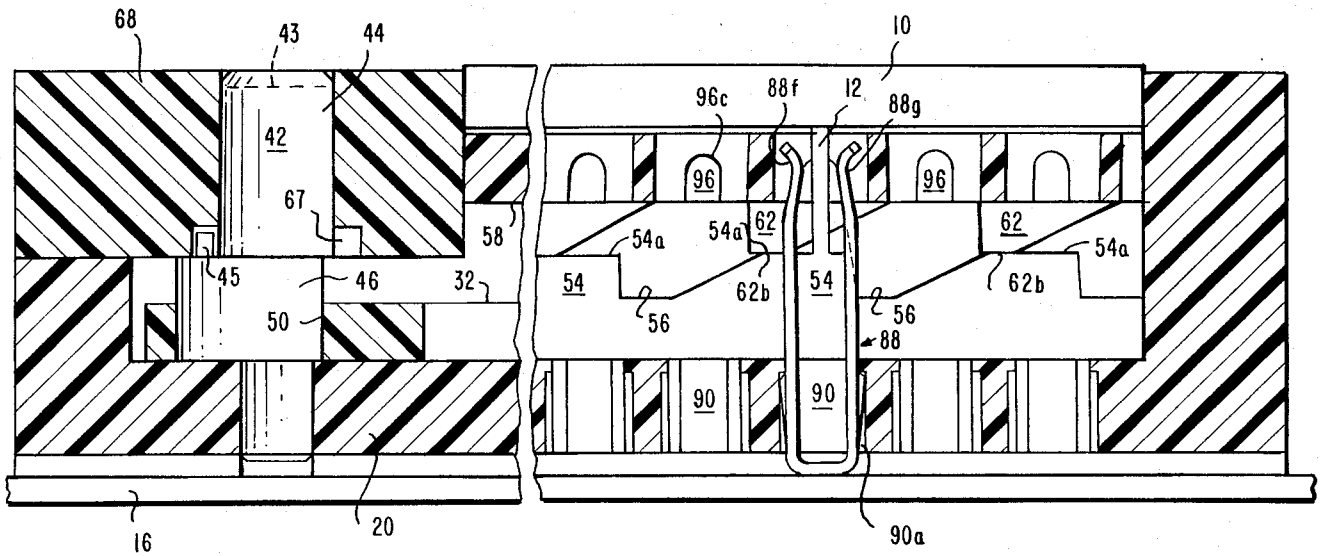
FIG. 11 is a view, as in FIG. 9, but with the cam plate in operative position, i.e., engaging the socket elements to oppose its self-bias and displacing such socket elements to facilitate pin entry therein.

Upon rotation of the cam actuator pin 42, for example, counterclockwise from its position in FIG. 9, the cam surfaces are moved to their active position as shown in FIG. 11. The cam actuator pin 42 may have a post 45 projecting therefrom to extend into an arcuate recess 67 formed in the lower surface of the cap 68. Such recess may be in the form of a half-circular track to provide end stops for the post 45 so as to limit the rotational movement of the pin 42. The rotation of the pin 42 within the cam actuator slot 50 causes the pin eccentric portion 46 to move the cam actuator 32 longitudinally leftward as depicted in the drawing figures within the base 20. The inclined surfaces of the facing ramps 54 and 62 engage each other upon such movement and, as the cam plate 58 is restrained from longitudinal movement, the cam plate 58 is lifted upward in a direction common with the upward direction of the contacts 88. The uppermost position of the cam plate 58 is illustrated in FIG. 11 where the flat lower surfaces 62*b* of cam ramps 62 are seated on the flat upper surfaces 54*a* of the cam actuator ramp 54.

Figure 12:
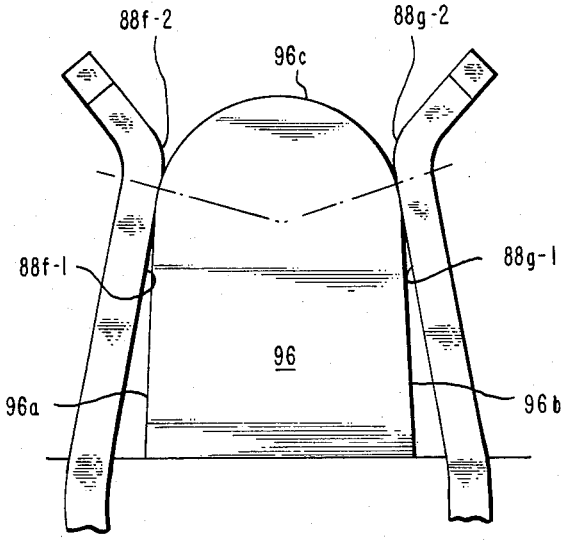
FIG. 12 is an enlarged, fragmented view showing the cam surface in the engaged position with the socket element as illustrated in FIG. 11.

In this position as depicted in FIG. 11, the inclined contact camming portions 88*f* and 88*g* are engaged by the cam surfaces 96*c* and 98*c*. As such, the contact self-bias is opposed and the contact facing elements are displaced elastically outwardly of one another. The VLSI pin 12 is readily inserted into contact 88 under this condition. Subsequent to insertion of the pins 12 into the contacts 88, the cam actuator pin may then be rotated clockwise to release the bias-opposing forces on the contact facing elements and return the cam plate 58 and cam actuator 32 to the positions of FIG. 9. To facilitate the return of the cam plate 58 to its lowermost position, the connector is constructed in its preferred form, as shown in detail in FIG. 12, such that the curved cam surface, e.g., surface 96*c* engages the contact facing elements at their inclined portions 88*f*-1 and 88*g*-1 without extending vertically beyond the pin engaging portions 88*f*-2 and 88*g*-2. With such construction, a force having a downward component is provided by the self-bias of the contact facing elements and upon leftward longitudinal movement of the cam actuator 32, the contact facing elements urge the cam plate 58 downward until engagement therebetween ceases and the cam ramps 62 are seated in the cam actuator slots 56. It should be understood that other devices, such as suitably disposed springs, may also be used to provide such a downward force on the cam plate 58 to return it to its lower position.

It should be noted that the connector arrangement as described herein places both the cam plate 58 and cam actuator 32 in compression against the bottom floor 30 of the base 20 under the influence of the spring force of the contacts 88. Such construction substantially minimizes the problems of bowing or bending of the cam plate 58 upon movement upward to spread apart the contact elements. As a result, a larger array of pins than in the known art having very close centers in both row and column directions (e.g., 0.1 inch by 0.1 inch) can be accommodated without problems of the strength of the material or the stiffness of the cam plate itself.

Having described the construction and operation of the preferred connector 18 herein, it should now be appreciated that multi-pin connections between the pins of a VLSI device and a companion PCB may be readily effected with zero insertion force. Low height profile of the connector is achieved by the inclined cam ramp and slot configurations of the cam plate and cam actuator and by the utilization of cam surfaces disposed within apertures provided in the cam plate, such apertures being constructed to receive both the contact facing elements and the VLSI terminal pins therein while defining partial boundaries about the VLSI pins. Such lower profile not only provides an advantage in height but permits the VLSI device 10 to be situated closer to the PCB 16 resulting in a shorter inductive length of the signal paths therebetween. It should also be understood that variations of the invention may be made within its contemplated scope. For example, while zero insertion force is preferred, the widths, w, of the cam elements 96 and 98 may be formed to give rise to slight frictional sliding between the pins 12 and the contact facing elements in a manner of a low insertion force connection.

Various other modifications to the foregoing disclosed connector will be evident to those skilled in the art. Thus, the particularly described preferred embodiment is intended to be illustrative and not limited thereto. The true scope of the invention is set forth in the following claims.

What is claimed is:

1. An electrical connector for interconnecting a plurality of terminal pins in predetermined array to companion apparatus, comprising:

(a) a housing;

(b) a plurality of contacts supported by said housing in said array and extending in a common direction, each such contact having a first terminal for connection to said companion apparatus and a second terminal adapted for receiving one such terminal pin and having facing elements self-biased into preselected attitude, each facing element defining a partial boundary surface for said terminal pin upon receipt thereof;

(c) cam means supported for movement in said housing in said common direction, said cam means adapted for receiving said terminal pins and defining a further partial boundary surface for each said terminal pin upon receipt thereof, said cam means being movable between a first position wherein said cam means engages said facing elements of all such second terminals to oppose such self-bias thereof and displace said facing elements from said preselected attitude whereby said pins may be readily received in said second terminals, and a second position wherein said cam means does not oppose said second terminal self-bias whereby said facing elements may exert full force of said self-bias upon pins therebetween; and (d) cam actuator means movable in a direction transverse to said common direction for moving said cam means between said first position and said second position.

2. An electrical connector for interconnecting a plurality of terminal pins in predetermined array to companion apparatus, comprising:

(a) a housing;

(b) a plurality of contacts supported by said housing in said array and extending in a common direction, each such contact having a first terminal for connection to said companion apparatus and a second terminal adapted for receiving one such terminal pin and having facing elements self-biased into preselected attitude;

(c) cam means supported for movement in said housing in said common direction, said cam means defining a plurality of openings, each receiving one of said contacts therein and for receiving one of said terminal pins therein, said cam means including a cam surface within each of said openings, said cam means being movable between a first position wherein said cam surfaces engage said facing elements of all such second terminals to oppose such self-bias thereof and displace said facing elements from said preselected attitude whereby said pins may be readily received in said second terminals, and a second position wherein said cam surfaces do not oppose said second terminal self-bias whereby said facing elements may exert full force of said self-bias upon pins therebetween; and (d) cam actuator means movable in a direction transverse to said common direction for moving said cam means between said first position and said second position.

3. An electrical connector according to claim 2, wherein said cam means comprises a plate member defining said plurality of openings therethrough, each opening being in registry with said second terminals in receiving such second terminals therein, said housing supporting said plate member for movement in said common direction.

4. An electrical connector according to claim 3, wherein said cam surfaces within said openings define partial boundary surfaces of each such opening.

5. An electrical connector according to claims 1 or 2, wherein said cam means and said cam actuator means comprise cooperating adjacent camming surfaces for effecting movement of said cam means.

6. An electrical connector according to claim 5, wherein said camming surfaces of said cam means and said cam actuator means each comprise a plurality of opposed cooperating inclined cam ramps and slots successively spaced on each camming surface.

7. An electrical connector according to claim 6, wherein said inclined cam ramps terminate in flat surfaces, said flat surfaces of cooperating cam ramps being in contact when said cam means is in said first position and said flat surfaces being disposed in opposing slots when said cam means is in said second position.

8. An electrical connector according to claim 7, wherein said cam means comprises a plate member overlying said cam actuator means, and having a lower surface comprising said inclined cam ramps and slots, said housing supporting said plate member for movement in said common direction.

9. An electrical connector according to claim 8, wherein said cam actuator means comprises a plate element underlying said plate member, and having an upper surface comprising said inclined cam ramps and slots, said housing supporting said plate element for transverse sliding movement.

10. An electrical connector according to claim 9, wherein said housing includes a base having a floor surface and wherein said plate member and said plate element are in compression against the base floor surface when said cam means is in said first position.

11. An electrical connector according to claims 1 or 2, wherein each of said facing elements includes a cam portion extending inwardly toward each other and in a direction inclined relative to said common direction, each said cam portion terminating in a terminal pin engaging portion.

12. An electrical connector according to claim 11, wherein said cam means comprises contact engaging portions adapted to engage each said inclined cam portion of said contacts in the course of movement of said cam means into said first position.

13. An electrical connector according to claim 12, wherein said contact engaging portions of said cam means are limited in movement in said common direction to not engage said terminal pin engaging portions of said contacts when said cam means is in said first position whereby the inclined cam portions of said contacts provide a bias of said cam means in a direction toward said second position.

14. An electrical connector for interconnecting a plurality of terminal pins in a closely spaced row and column array to companion apparatus, comprising:

(a) a housing having a base;

(b) a plurality of contacts supported by said housing in said array and extending in a common direction, each such contact having a first terminal for connection to said companion apparatus and a second terminal adapted for receiving one such terminal pin and having facing elements self-biased into preselected attitude, each facing element defining a partial boundary surface for said terminal pin upon receipt thereof;

(c) cam means supported for movement in said housing in said common direction, said cam means adapted for receiving said terminal pins and defining a further partial boundary surface for each said terminal pin upon receipt thereof, said cam means being movable between a first position wherein said cam means engages said facing elements of all such second terminals to oppose such self-bias thereof and displace said facing elements from said preselected attitude whereby said pins may be readily received in said second terminals, and a second position wherein said cam means does not oppose said second terminal self-bias whereby said facing elements may exert full force of said self-bias upon pins therebetween; and (d) cam actuator means movable along the base of said housing in a direction transverse to said common direction for moving said cam means between said first position and said second position, said cam means and said cam actuator means being supported in compressive relation against said housing base.

15. An electrical connector according to claim 14, wherein said cam means comprises a plate member of rigid plastic.

16. An electrical connector according to claim 14, wherein said base comprises a substantially planar member including a plurality of stiffening elements thereon whereby said base may be maintained relatively thin but stiff.

* * * * *